United States Patent [19]

Lewy

[11] 4,411,032

[45] Oct. 25, 1983

[54] NECK REST FOR SHAMPOO BOWLS

[76] Inventor: Laury P. Lewy, 1310 Ashland, Wilmette, Ill. 60091

[21] Appl. No.: 344,921

[22] Filed: Feb. 2, 1982

Related U.S. Application Data

[63] Continuation-in-part of Ser. No. 229,459, Jan. 29, 1981, abandoned.

[51] Int. Cl.[3] ..... A54D 44/10; A54D 19/00

[52] U.S. Cl. ..... 4/523; 4/515

[58] Field of Search ..... 4/515, 516, 517, 518, 4/519, 520, 521, 522, 523, 575

[56] References Cited

U.S. PATENT DOCUMENTS

| | | | |
|---|---|---|---|
| 1,011,448 | 12/1911 | Lahl | 4/575 |
| 1,039,334 | 9/1912 | Trick | 4/575 |
| 1,650,743 | 11/1927 | Seckbach | 4/575 |
| 2,261,476 | 11/1941 | Kiefer | 4/519 |
| 2,475,259 | 7/1949 | Singleton | 4/515 |
| 2,948,903 | 8/1960 | Gilmer | 4/523 |
| 3,078,474 | 2/1963 | Chaitlen | 4/575 |

*Primary Examiner*—Henry K. Artis

*Attorney, Agent, or Firm*—Laff, Whitesel, Conte & Saret

[57] ABSTRACT

A neck rest includes a body member made of flexible elastomeric material which is impervious to shampoos, hair conditioners and other chemicals commonly used in hair treatment. A central compartment is formed in the body member and filled with a padding material to provide a comfortable cushion. To keep the neck rest properly positioned behind the neck of the person whose hair is being shampooed or otherwise treated, a pair of tabs are provided on the neck rest to adjustably and removably attach the neck rest around the person's neck or to a cape placed over the person. Hook and loop material may be provided on the tabs and the cape to secure the tabs together or to the cape. When the tabs are placed around the person's neck whose hair is being shampooed or otherwise treated, the hook and loop material on the tabs can be removably secured together at any point along a predetermined length of the tabs or to the cape to accommodate different sized necks.

13 Claims, 13 Drawing Figures

NECK REST FOR SHAMPOO BOWLS

BAKGROUND OF THE INVENTION

This is a continuation-in-part of my earlier application Ser. No. 229,459, filed Jan. 29, 1981 and now abandoned.

This invention relates to neck rests and more particularly to neck rests adaptable to fit different sized and shaped shampoo bowls commonly found at beauty parlors and hair styling salons.

Conventional shampoo bowls are usually provided with a U-shaped cut-away portion along the front rim of the bowl as shown in U.S. Pat. No. 1,917,773 to receive the nape of a person's neck. A person desiring to have his or her hair shampooed or otherwise treated rests the back of his or her neck in the U-shaped cut-away portion so that his or her hair falls within the shampoo bowl. This provides a convenient and efficient arrangement for a beautician or hair stylist to wash or treat a person's hair with minimal mess.

There is, however, a disadvantage to this arrangement. The U-shaped cut-away portion of the bowl is usually made of the same hard material as the shampoo bowl and, consequently, does not provide a comfortable resting place for a person's neck. Also, the shape of the rim of the bowl along the cut-away portion often does not provide adequate support for a person's neck and can cause neck strain.

Prior art devices such as that shown in U.S. Pat. No. 2,948,903 have been designed in an attempt to solve this problem. These devices have several drawbacks. They are not adaptable to fit different sized and shaped shampoo bowls, but only one particular sized or shaped bowl. Also, the prior art devices often do not provide an efficient method for keeping sanitary the surface upon which a person must rest his or her neck. As can be seen from the device of U.S. Pat. No. 2,948,903, each person using the neck rest must place his or her neck on the same surface as that used by others. To keep this surface sanitary, it should be thoroughly scrubbed after each customer. This is time consuming and inefficient. Thus, there is a need for a comfortable neck rest which fits different sized and shaped shampoo bowls and can easily and efficiently be kept sanitary.

Accordingly, an object of the present invention is to provide a neck rest for use with shampoo bowls which provides a comfortable resting place for a person's neck.

Another object of the present invention is to provide a neck rest for use with shampoo bowls which is adaptable to fit different sized and shaped bowls.

A further object of the present invention is to provide a neck rest for use with shampoo bowls which can easily and efficiently be kept sanitary by professional beauticians and hair stylists operating in beauty salons, barber shops and similar commercial establishments.

Still another object of the present invention is to provide a neck rest for use with shampoo bowls that is impervious to chemicals commonly used to shampoo and treat hair.

Further objects will be manifest from the description, drawings and claims.

SUMMARY OF THE INVENTION

In keeping with one aspect of the invention, a neck rest includes a body member made of a flexible elastomeric material which is impervious to shampoos, hair conditioners and other chemicals commonly used in hair treatment. A central compartment is formed in the body member and filled with a soft non-toxic material such as liquid silicone to provide a comfortable cushion. To keep the neck rest properly positioned behind the neck of the person whose hair is being shampooed or otherwise treated, a pair of tabs may be provided on the neck rest to removably attach the neck rest to the shampoo bowl or around the person's neck by means of an adhesive material applied to the tabs. Instead of using tabs, a pliable wire may be embedded in the body member around its circumference. The pliable wire enables the neck rest to maintain its shape, after being fitted on the bowl rim, so that the neck rest does not slip off the rim. At least one peg or other means may be provided on the body member to removably attach a disposable cover to the neck rest.

DESCRIPTION OF THE PREFERRED EMBODIMENTS

Figure 1:
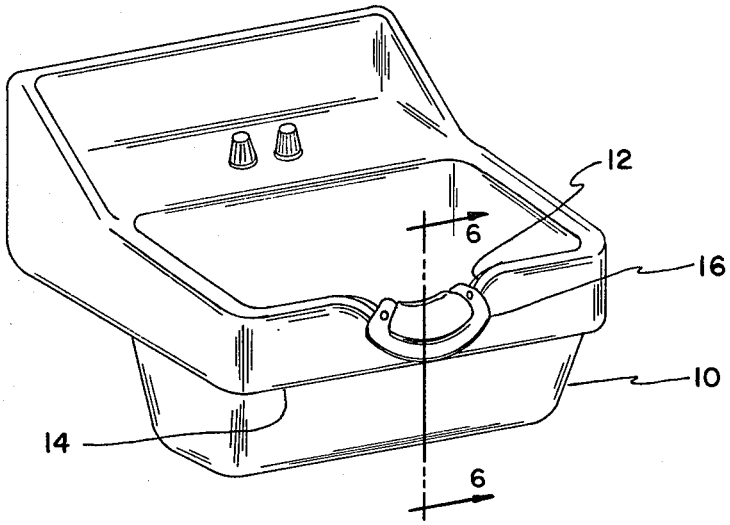
FIG. 1 is a front elevational view of one embodiment of this invention located on a hair shampoo bowl.

As shown in FIG. 1, a shampoo bowl 10 is provided with a U-shaped cut-away portion 12 along the front rim 14. The cut-away portion 12 is designed to receive the nape of the neck of a person whose hair is to be shampooed or otherwise treated. The neck rest 16 fits within the cut-away portion 12 as shown in FIGS. 1, 6, 8 and 12.

Figure 4:
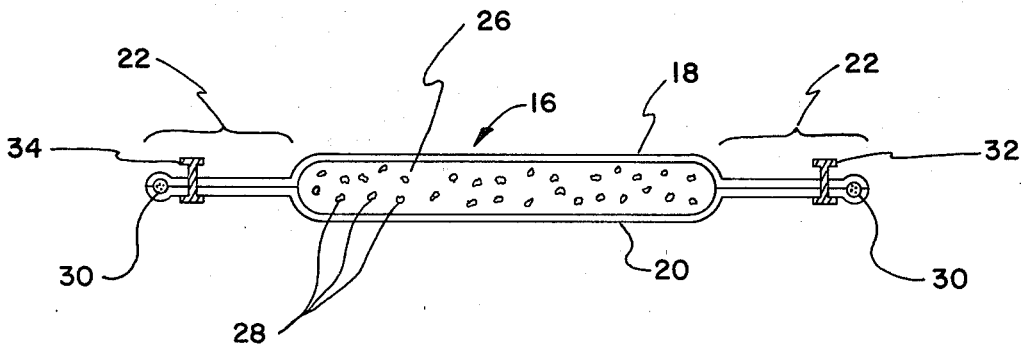
FIG. 4 is a cross-sectional view of the embodiment of FIG. 1 taken along line 4—4 in FIG. 3.
Figure 5:
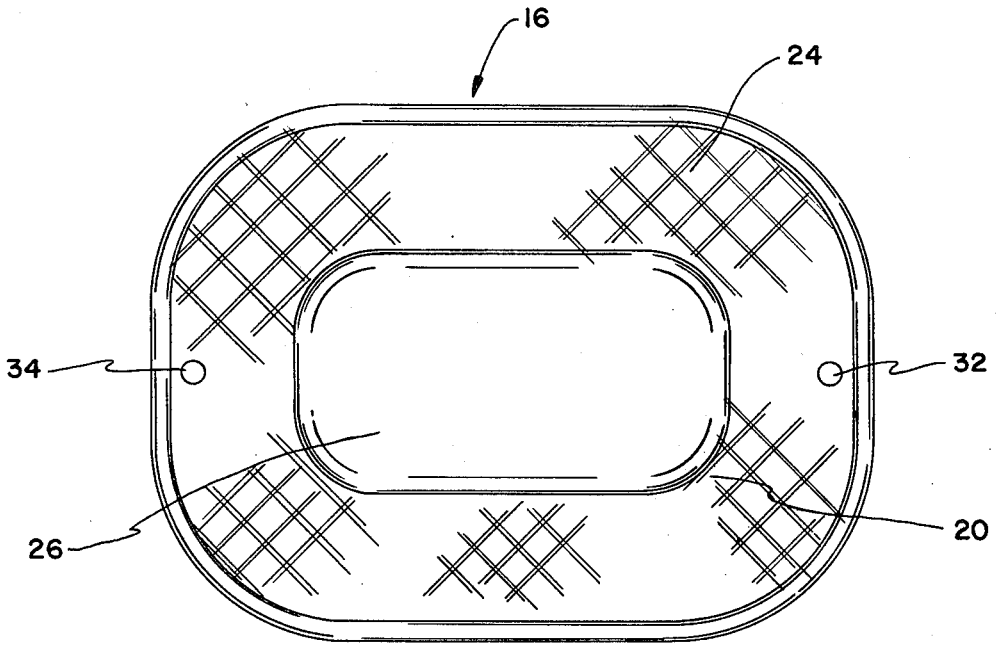
FIG. 5 is a bottom plan view of the embodiment of FIG. 1.

As best shown in FIG. 4, the neck rest 16 comprises upper member 18 and lower member 20 sealed together along flange portion 22. Member 20 may be provided with a textured or waffle-like surface 24 as shown in FIG. 5 to provide a non-skid surface to better grip the rim of the shampoo bowl. Members 18 and 20 are made from a soft, flexible, elastomeric material, such as polyvinyl chloride, which is impervious to chemicals commonly used to professionally shampoo and treat hair.

The elastomeric material used to make members 18 and 20 must be pliable enough so that the members may be formed to fit the cut-away portion 12 of different sized and shaped bowls but rigid enough to retain the shape formed so that the neck rest does not slip off the bowl rim 14.

Compartment 26 is formed in the center of neck rest 16 to provide a pliable cushion and is filled with a non-toxic substance 28 such as sponge rubber, liquid silicone, viscous glycerine, ethylene glycol or polyethylene foam. As seen in FIG. 4, compartment 26 is greater in thickness than flange portion 22.

In a second embodiment, the elastomeric material used to make members 18 and 20 need not be as rigid as the material used in the first described embodiment since pliable wire 30 is embedded in the circumference of neck rest 16 between upper and lower members 18 and 20 as seen in FIG. 4. Wire 30 enables the neck rest to be formed to fit U-shaped cut-away portion 12 and retain the shape formed so that it does not slip off. The wire may be soft aluminum, milled steel, spring or baling wire.

Figure 2:
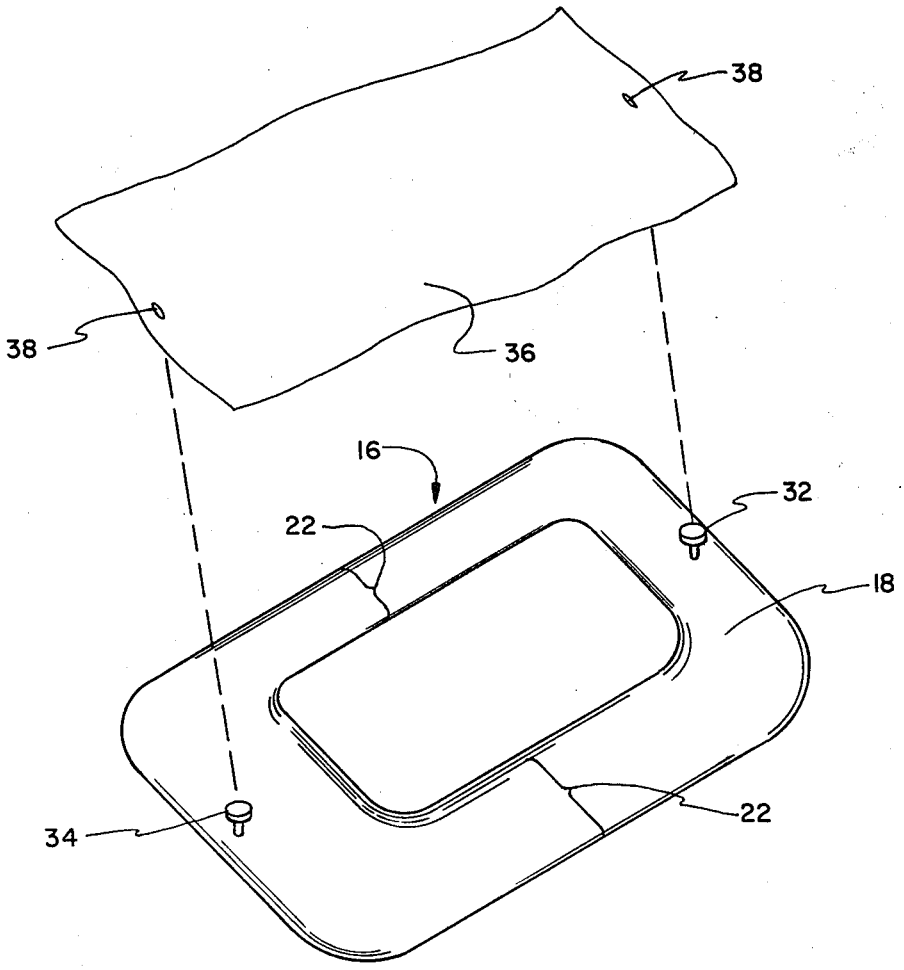
FIG. 2 is a perspective view of the embodiment of FIG. 1.
Figure 3:
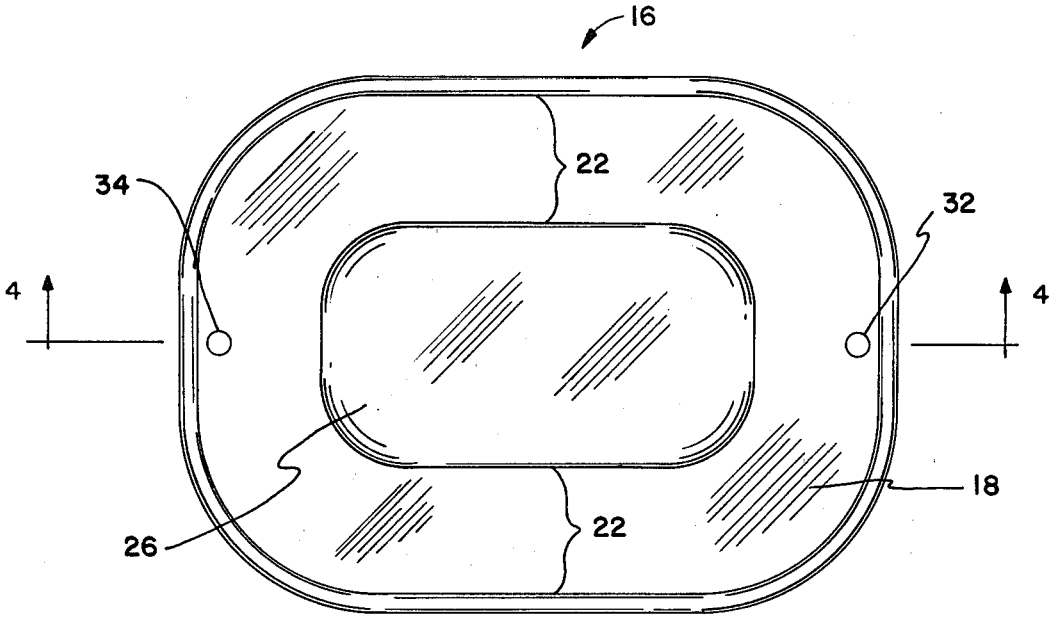
FIG. 3 is a top plan view of the embodiment of FIG. 1.

As seen in FIGS. 2 and 4, pegs 32 and 34 are secured in the flange portion 22 of members 18 and 20 and extend upwardly above member 18. The pegs 32, 34 are disposed opposite one another to removably secure disposable cover 36 to the neck rest by means of slits 38 which fit over the pegs. The disposable cover may be made of any suitable material such as polyethylene or tissue to provide a sanitary surface for each person who uses the neck rest.

Figure 8:
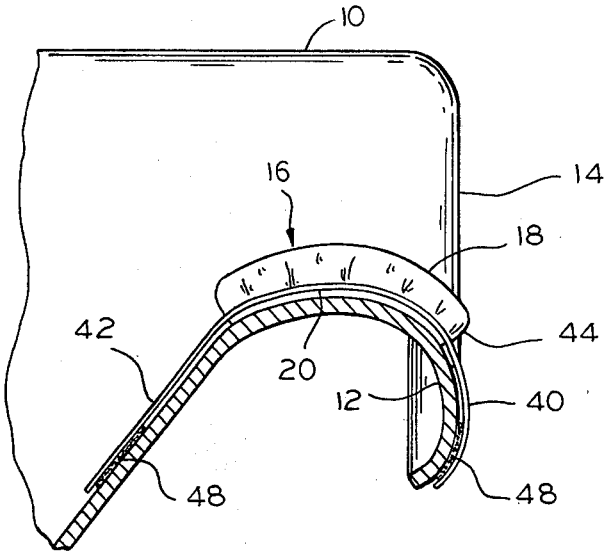
FIG. 8 is a cross-sectional view of the embodiment of FIG. 7 located on a hair shampoo bowl.
Figure 7:
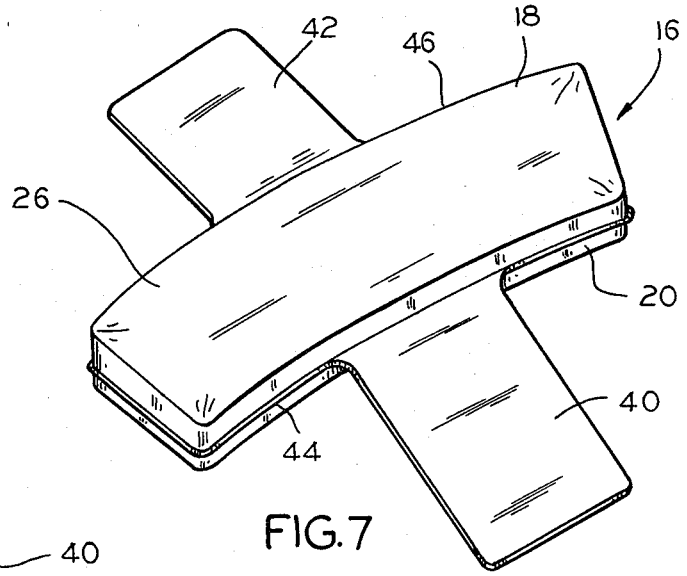
FIG. 7 is a perspective view of a second embodiment of the invention.
Figure 9:
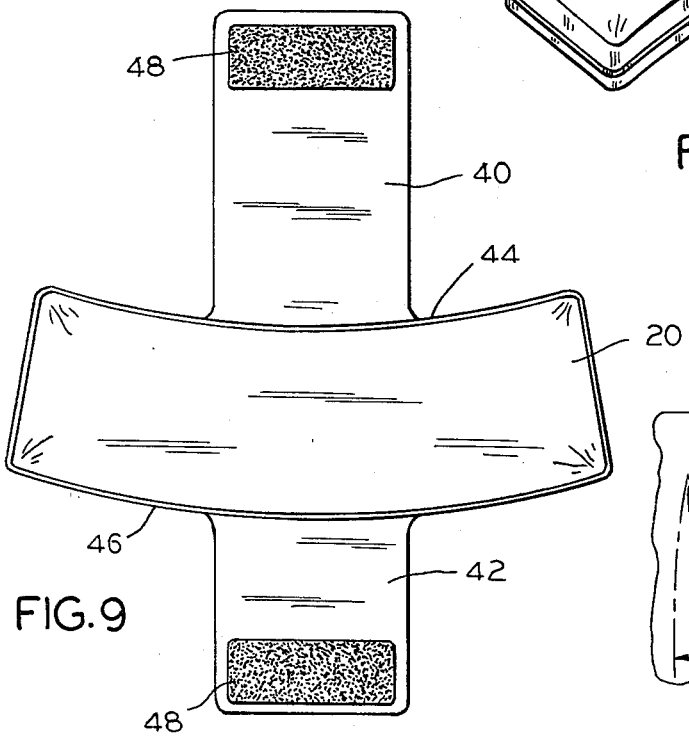
FIG. 9 is a bottom plan view of the embodiment of FIG. 7.
Figure 12A:
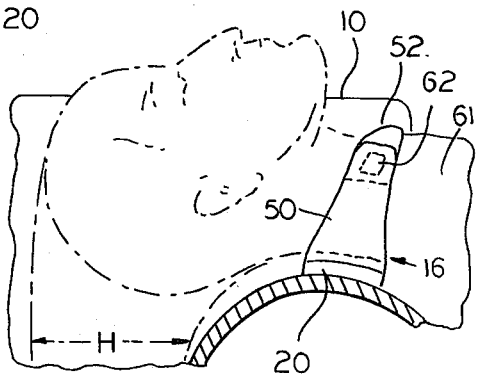
FIG. 12A is a side elevational view partly in cross-section showing the embodiment of FIG. 10 in use.

A third embodiment of the invention is shown in FIGS. 7, 8 and 9. In the third embodiment, as in the second embodiment, the elastomeric material used to make members 18 and 20 is not as rigid as the material used in the first described embodiment. Tabs 40 and 42 extend outwardly from sides 44 and 46 of the neck rest as shown in FIG. 7. As shown in FIG. 9, the underside of tabs 40 and 42 are coated with an adhesive material 48 or double-faced tape to provide a means to removably secure the neck rest to the U-shaped cut-away portion 12 of shampoo bowl 10. Double-faced tape or some other suitable type of adhesive material may also be applied to the underside of member 20. In this third embodiment, compartment 26 forms the entire body of neck rest 16 and no flange area is provided as in the first two embodiments. Members 18 and 20 are curved forming concave edge 44 to conform to and fit against the general area of the back of the neck or shoulders which rest on the rim of the shampoo bowl 10 to prevent water from the shampooing process from running down a person's neck or shoulders.

Figure 10:
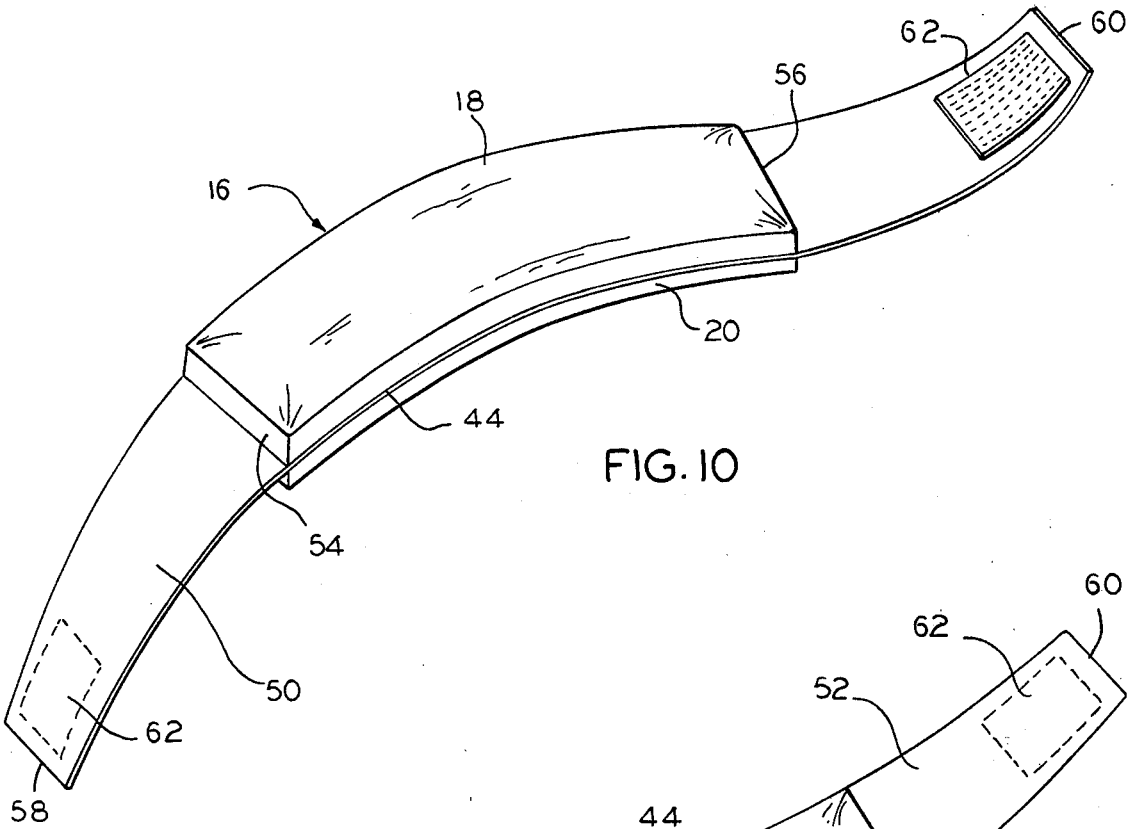
FIG. 10 is a perspective view of a third embodiment of the invention.
Figure 11:
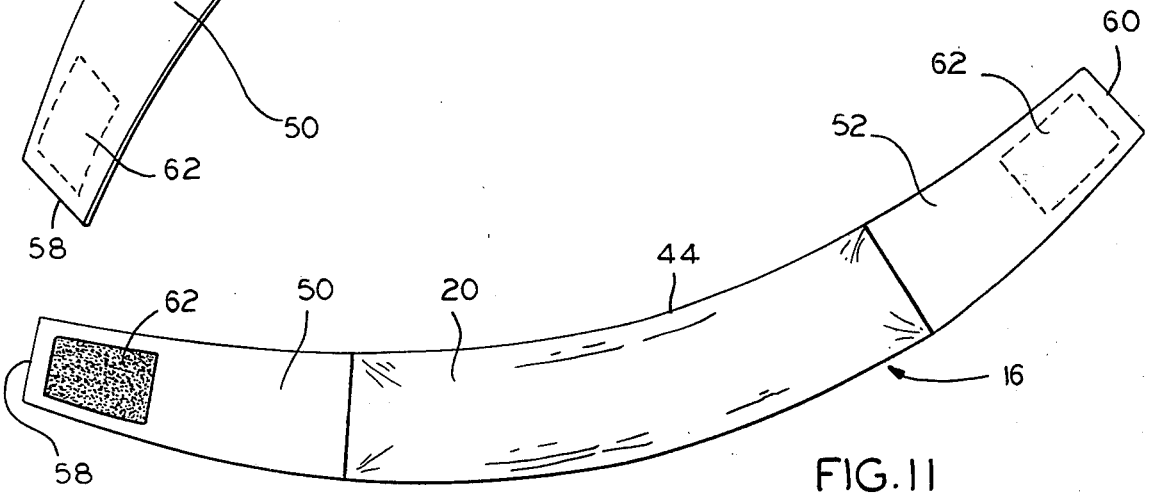
FIG. 11 is a bottom plan view of the embodiment of FIG. 10.
Figure 12:
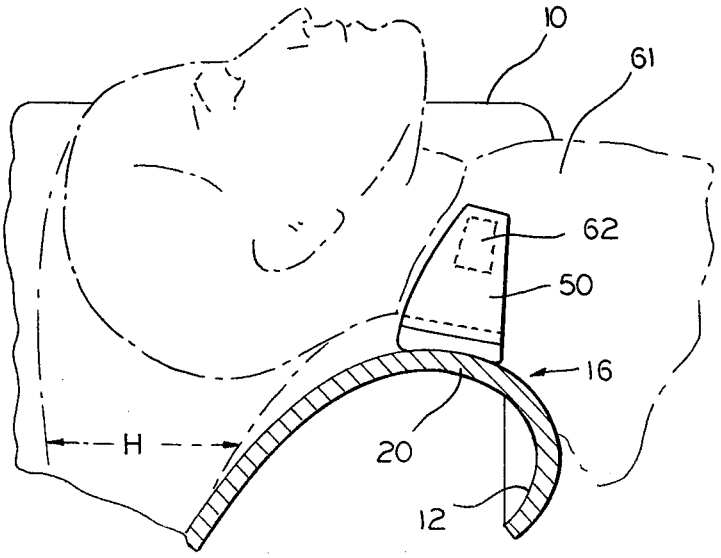
FIG. 12 is a side elevational view partly in cross-section showing the embodiment of FIG. 10 in use.

A fourth embodiment of the invention is shown in FIGS. 10, 11 and 12. As with the second and third embodiments, the elastomeric material used to make members 18 and 20 is not as rigid as the material used in the first described embodiment. Again, the concave edge 44 of the neck rest is curved to generally conform to the contours at the back of the neck or shoulders. Tabs 50 and 52 extend outwardly from ends 54 and 56 of the neck rest as shown in FIG. 10 and gradually taper, in width, from neck rest 16 to ends 58 and 60. The tabs are long enough so that they may be wrapped around a person's neck or removably attached to a cape 61 that is customarily placed over a person whose hair is being shampooed (see FIG. 12).

An elongated piece of hook and loop material 62 sold under the trademark "Velcro" is provided on the bottom side of tab 50 near end 58 and on the upper side of tab 52 near end 60 so that tabs 50 and 52 can be removably secured together when wrapped around a person's neck or removably secured to the cape 61 covering the person. If tabs 50 and 52 are to be secured to such a cape, the cape 61 is also provided with pieces of hook and loop material to receive pieces 62 disposed on the tabs. To accommodate necks of different sizes, the elongated pieces of hook and loop material 62 may be secured at any point along their lengths thereby shortening or lengthening the effective length of tabs 50 and 52. To accommodate a person with a relatively small neck, hook and loop material pieces 62 are fastened together near their inner ends to shorten the effective length of tabs 50 and 52 that extends around the person's neck. To accommodate a person with a relatively large neck, pieces 62 would be fastened together near their outer ends to increase the effective length of tabs 50 and 52 that extends around the person's neck. Instead of pieces 62, a series of snaps may be used to fasten tabs 50 and 52.

Figure 6:
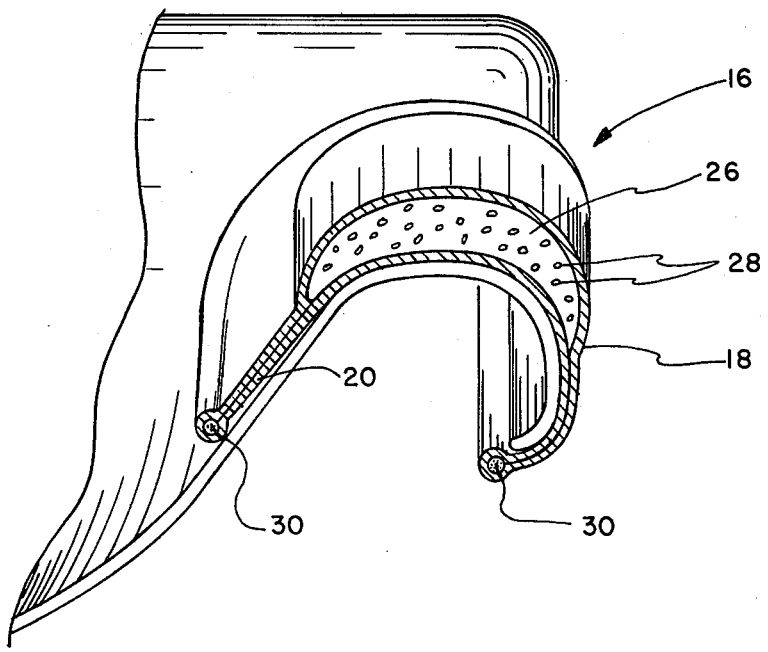
FIG. 6 is a cross-sectional view of the embodiment of FIG. 1 taken along line 6—6 in FIG. 1.

In the use of either of the first two embodiments, neck rest 16 is placed on the rim 14 along cut-away portion 12 as shown in FIG. 6. As can be seen in FIG. 6, when the neck rest is formed to fit the rim 14, compartment 26 extends upwardly away from the rim to provide a comfortable cushion. A disposable cover 36 may be attached to the neck rest by means of pegs 32, 34 either before or after the neck rest is fitted on the bowl rim. Because compartment 26 is filled with a soft and pliable material 28, it deforms to accommodate the shape of the neck or shoulders of the person whose hair is to be shampooed or treated. After use, disposable cover 36 is removed and discarded. The neck rest may be left on the shampoo bowl for the next person or removed and fitted to another bowl for use.

In the use of the third embodiment (FIG. 8), neck rest 16 is placed on the rim 14 along cut-away portion 12 with side 44 facing outwardly from the shampoo bowl (i.e. toward the person whose neck is resting on the neck rest). Tabs 40 and 42 are pressed against the sides of shampoo bowl 10 so that the double-faced tape or other suitable adhesive material 48 applied to the underside of the tabs will securely hold the neck rest in place on rim 14 (see FIG. 8).

In the use of the fourth embodiment (FIGS. 10, 11, and 12), neck rest 16 is placed behind the person's neck whose hair H (see FIG. 12) is to be shampooed or otherwise treated and tabs 50 and 52 are wrapped around the person's neck or removably secured to the cape 61 placed over the person. Hook and loop pieces 62 are fastened together when tabs 50 and 52 are wrapped around the person's neck, or they are fastened to like pieces of hook and loop material on the cape 61 covering the person when the neck rest is to be secured to the cape. After use, tabs 50 and 52 are disconnected and the neck rest is removed.

While specific embodiments of this invention have been shown and described, modifications thereof may be made which fall within the spirit and scope of this invention. The appended claims are, therefore, intended to cover any such modifications, as well as the embodiments specifically disclosed herein.

I claim:

1. A neck rest to be secured around a person's neck and to fit different sized and shaped shampoo bowls, said neck rest comprising a body of flexible elastomeric material having an upper and lower surface; a compartment formed between the upper and lower surfaces filled with a padding material; a pair of elongated tab members extending outwardly from opposite ends of the body shaped to fit around a person's neck; and means disposed on said tab members to adjustably and removably secure said tabs together at any desired length around a person's neck, whereby said tabs may be adjusted to fit snugly around different sized necks.

2. The neck rest of claim 1 wherein the body is curved to fit the shape of the back of a person's neck.

3. The neck rest of claim 2 wherein the body comprises an upper body member of flexible elastomeric material and a lower body member of flexible elastomeric material sealed to the upper body member along its circumference.

4. The neck rest of claim 3 wherein the lower body member has an outer textured waffle-like surface.

5. The neck rest of claim 4 wherein the upper and lower body members are made of polyvinyl chloride.

6. The neck rest of claim 1 wherein said means to adjustably and removably secure said tabs comprises a pair of elongated pieces of hook and loop material with one piece of said pair disposed on one tab member and the other piece disposed on the other tab member so that when said tab members are placed around a person's neck the pair of hook and loop material pieces can be removably secured together at any point along a predetermined length of said tab members to fasten and adjust the length of the tab members to accommodate different sized necks.

7. The neck rest of claim 1 wherein said tab members gradually taper in width from the body to the outer ends of said tabs.

8. A neck rest for use when shampooing or otherwise treating a person's hair to fit behind a person's neck by securing it to a cape placed over the person whose hair is being shampooed or treated, said neck rest comprising a body member made of flexible elastomeric material; a pair of elongated tab members extending outwardly from opposite ends of the body; and means disposed on said tab members and said cape to adjustably and removably secure said tabs to said cape at any desired point along a predetermined length of said tab members to accommodate different sized necks.

9. The neck rest of claim 8 wherein said means to adjustably and removably secure said tabs to said cape comprises two pairs of elongated pieces of hook and loop material with a piece of each of said pairs disposed on each tab member and the other piece of each of said pairs disposed on said cape so that when said tab members are placed on said cape the pairs of hook and loop material pieces can be removably secured together at any point along their lengths to adjustably fasten the tab members to the cape to accommodate necks of different sizes.

10. The neck rest of claim 9 wherein the body member is curved to fit the shape of the back of a person's neck.

11. The neck rest of claim 10 wherein the body member comprises an upper portion of flexible elastomeric material, a lower portion of flexible elastomeric material sealed to the upper body member along its circumference, and a compartment formed between the upper and lower portions filled with a padding material.

12. The neck rest of claim 11 wherein the lower portion of the body has an outer textured waffle-like surface.

13. The neck rest of claim 12 wherein the upper and lower portions of the body member are made of polyvinyl chloride.

* * * * *